US011365669B2

(12) United States Patent
Saurat

(10) Patent No.: US 11,365,669 B2
(45) Date of Patent: Jun. 21, 2022

(54) HEAT SHIELD ASSEMBLY FOR A VEHICLE EXHAUST SYSTEM AND EXHAUST SYSTEM COMPONENT OF A MOTOR VEHICLE

(71) Applicant: Faurecia Emissions Control Technologies, Germany GmbH, Augsburg (DE)

(72) Inventor: David Saurat, Gersthofen (DE)

(73) Assignee: Faurecia Emissions Control Technologies, Germany GmbH

( * ) Notice: Subject to any disclaimer, the term of this patent is extended or adjusted under 35 U.S.C. 154(b) by 1412 days.

(21) Appl. No.: 15/003,952

(22) Filed: Jan. 22, 2016

(65) Prior Publication Data

US 2016/0215676 A1 Jul. 28, 2016

(30) Foreign Application Priority Data

Jan. 23, 2015 (DE) ..... 10 2015 100 994.3

(51) Int. Cl.
*F01N 13/14* (2010.01)

(52) U.S. Cl.
CPC ..... *F01N 13/14* (2013.01); *F01N 2260/20* (2013.01); *F01N 2310/04* (2013.01)

(58) Field of Classification Search
CPC ..... F28F 13/00; F01N 13/00; F01N 13/08; F01N 13/10; F01N 13/102; F01N 13/14; F01N 14/141; F01N 2260/00; F01N 2260/20; F01N 2310/00; F01N 2310/02; F01N 2310/04; F01N 2310/14; F01N 2510/02; B60K 13/04; B23K 3/085
USPC ..... 165/135, 136
See application file for complete search history.

(56) References Cited

U.S. PATENT DOCUMENTS 3,963,087 A 6/1976 Grosseau
4,085,816 A * 4/1978 Amagai ..... F01N 13/14 180/89.2
4,183,994 A * 1/1980 Tsubaki ..... F01N 13/102 428/443

(Continued)

FOREIGN PATENT DOCUMENTS

CN 201221396 4/2009
CN 201273208 7/2009

(Continued)

OTHER PUBLICATIONS

English Summary of the CN Office Action dated Oct. 17, 2017.

(Continued)

*Primary Examiner* — Len Tran
*Assistant Examiner* — Gustavo A Hincapie Serna
(74) *Attorney, Agent, or Firm* — Carlson, Gaskey & Olds, P.C.

(57) ABSTRACT

An exhaust system component of a motor vehicle includes a gas-carrying housing, a heat shield seated on an outside of the housing, and at least one wire mesh provided at least partly between the heat shield and the housing. The wire mesh includes a first attachment point and a second attachment point. The heat shield is attached to the housing via the wire mesh, and the wire mesh is attached to both the heat shield, via the first attachment point, and to the housing via the second attachment point. The first attachment point is separate from the second attachment point.

21 Claims, 4 Drawing Sheets

(56) References Cited

U.S. PATENT DOCUMENTS 5,036,947 A 8/1991 Metzger
5,323,989 A * 6/1994 Hamada ..... B60K 13/04 180/296
5,606,857 A * 3/1997 Harada ..... F01N 13/1811 60/322
5,799,395 A 9/1998 Nording et al.
5,907,134 A 5/1999 Nording et al.
5,992,560 A * 11/1999 Matsuoka ..... F01N 1/24 181/252
6,155,046 A * 12/2000 Kato ..... F01N 13/102 60/322
6,318,734 B1 * 11/2001 Boskamp ..... F01N 13/10 277/591
6,510,833 B1 * 1/2003 Anthon ..... F02M 35/10321 123/198 E
6,530,443 B1 * 3/2003 Tsuruta ..... F01N 13/08 180/89.2
6,598,389 B2 * 7/2003 Chen ..... F01N 13/102 123/169 PH
6,874,317 B2 * 4/2005 Sugaya ..... F02M 26/11 60/272
7,784,585 B2 * 8/2010 Greenwood ..... B60R 13/0869 181/211
7,930,884 B2 * 4/2011 Leroy ..... F01N 13/10 60/323
8,322,134 B2 * 12/2012 Wieland ..... F01N 3/035 181/227
8,870,510 B2 * 10/2014 Greenwood ..... B21F 33/00 411/443
9,856,776 B1 * 1/2018 Tan ..... F01N 13/1838
2004/0178016 A1 * 9/2004 Yamamoto ..... F01N 1/089 181/252
2005/0019714 A1 1/2005 Platts et al.
2005/0040576 A1 2/2005 Oxenknecht et al.
2005/0139416 A1 * 6/2005 Niwa ..... F01N 13/102 181/207
2007/0098954 A1 5/2007 Kozerski
2009/0158720 A1 * 6/2009 Krause ..... F01N 13/16 60/297
2011/0318526 A1 12/2011 Krus
2013/0098007 A1 * 4/2013 Waggoner ..... F01N 3/046 60/299
2015/0283504 A1 * 10/2015 Rhodes ..... B01D 53/9431 422/180
2016/0061074 A1 * 3/2016 Müller ..... F01N 13/14 181/256
2016/0207477 A1 7/2016 Ostermeier et al.
2016/0250918 A1 * 9/2016 Koyama ..... F02M 35/10013 180/68.3

FOREIGN PATENT DOCUMENTS

| | | | |
|---|---|---|---|
| CN | 101696650 | | 4/2010 |
| CN | 201554532 | | 8/2010 |
| CN | 201972772 | | 9/2011 |
| CN | 202202934 | U | 4/2012 |
| CN | 103899397 | | 7/2014 |
| DE | 4437380 | A1 | 7/1995 |
| DE | 19918301 | C1 | 10/2000 |
| DE | 202011001963 | U1 | 1/2012 |
| DE | 202011004619 | U1 | 4/2012 |
| DE | 202011109219 | U1 | 12/2012 |
| EP | 2703614 | A1 | 3/2014 |
| JP | 2003293765 | A | 10/2003 |
| WO | 2005019714 | A2 | 3/2005 |

OTHER PUBLICATIONS

Translation of German Search Report, completed Sep. 10, 2015.
Second Office Action for Chinese Patent Application No. 201610048860.1 dated Jul. 11, 2018.
English Summary of the DE Office Action dated Jun. 7, 2018.
French Search Report for French Application No. 1650508 dated Sep. 11, 2018.
Third Office Action for Chinese Patent Application No. 201610048860.1 dated Feb. 1, 2019.

* cited by examiner

HEAT SHIELD ASSEMBLY FOR A VEHICLE EXHAUST SYSTEM AND EXHAUST SYSTEM COMPONENT OF A MOTOR VEHICLE

RELATED APPLICATION

This application claims priority to DE 10 2015 100 994.3, filed Jan. 23, 2015.

TECHNICAL FIELD

The invention relates to a heat shield assembly for a vehicle exhaust system, and to an exhaust system component of a motor vehicle, which has a housing and a heat shield.

BACKGROUND

In exhaust systems of vehicles, individual components such as, for example, exhaust pipes, catalytic converters, and/or particulate filters, are usually thermally and acoustically insulated in order to protect the surroundings of this component from heat and to damp noises from the component.

For this purpose, heat shields are employed which are attached to the outer housing of the component of the exhaust system. As a rule, the heat shields are made of a thin metal sheet which is mounted at a distance from the housing.

In spite of this, the heat shield will heat up during operation of the exhaust system and will generate noises since vibrations of the housing are transferred to the heat shield.

US 2005/0040576 A1 and WO 2005/019714 A2 suggest heat shields which are attached to a housing by studs or bolts. A washer made of wire is circumscribing the stud or bolt, and acts as a dampener in one direction.

It is the object of the invention to provide a heat shield and a component for an exhaust system which reduce the temperatures of the heat shield and also the noise development of the heat shield.

SUMMARY

The invention provides a heat shield assembly for a vehicle exhaust system including a heat shield and at least one wire mesh configured to attach the heat shield to the exhaust system. The at least one wire mesh is attached to the heat shield at a first attachment point to form a preassembled unit. The at least one wire mesh includes a second attachment point for attachment to a housing of the vehicle exhaust system. The first attachment point is separate from the second attachment point. The at least one wire mesh is attached to the heat shield to form a preassembled unit. The invention is based on the fundamental idea that attaching the heat shield to the housing by a wire mesh thermally, and also mechanically, decouples the heat shield better from the housing. If the heat shield is attached to the housing via the wire mesh, the heat shield will heat up to a far lesser extent as compared to rigid, large-surface connections with the housing. In contrast to the above prior art in which the washers are used as dampeners, only, the present invention uses the mesh to hold the shield to the housing in all spatial directions, i.e. the mesh transfers all forces between the first and the second attachment points. Thus, the first and second attachment points rigidly attach a specific portion of the mesh to the shield and the housing, respectively. As the attachment points are distanced from each other, the mesh and not the attachment has to transfer all forces between the attachment points in all spatial directions.

Furthermore, the attachment of the wire mesh directly to the heat shield assembly provides a prefabricated unit which can be attached to the housing in a simple manner, thus allowing cost savings in production.

Preferably, the wire mesh is attached to the heat shield by a substance-to-substance bond and/or with an interlocking fit, in particular by welding, such as spot welding, soldering, brazing, crimping, adhesive bonding, and/or stapling/tacking. In this way, the wire mesh can be connected with the heat shield efficiently and durably.

For example, the wire mesh laterally projects over an edge of the heat shield, so that the heat shield assembly is simple to mount to the housing.

In addition, vibrations are damped by the wire mesh and are not transmitted to the heat shield, so that the noise emission is also reduced. Moreover, the use of a wire mesh between the heat shield and the housing prevents mechanical stresses between the housing and the heat shield, which may appear because of the different coefficients of expansion of the material of the housing and that of the heat shield.

The invention further provides an exhaust system component of a motor vehicle including a gas-carrying housing, a heat shield seated on an outside of the housing, and at least one wire mesh which is provided at least partly between the heat shield and the housing. The at least one wire mesh has a first attachment point and a second attachment point. The wire mesh is attached to both the heat shield, via the first attachment point, and to the housing via the second attachment point so that the wire mesh attaches the heat shield to the housing. The first attachment point is separate from the second attachment point. Furthermore, the first attachment point can be laterally offset from the second attachment point. In addition to the advantages already mentioned, this results in that the first attachment point and the second attachment point are spatially separate from each other, in an increased thermal and acoustic insulation of the heat shield from the housing, and in the possibility of making use of the wire mesh as an elastic buffer between the heat shield and the housing.

It is conceivable here that the heat shield is attached to the housing solely by the wire mesh, which improves the thermal and acoustic insulating effect.

For example, the heat shield is closed at the first attachment point, so that there is no need to make holes into the heat shield, thus saving manufacturing costs.

Preferably, the heat shield is essentially adapted to the shape of the housing, which allows an optimum utilization of the available installation space.

In one embodiment, the wire mesh is in the form of a strip and/or provision is made for a plurality of separate wire meshes, which allows the amount of wire mesh used to be reduced. This results both in cost savings and in an improved thermal and acoustic insulation.

For example, the heat shield has an edge, at least one of the wire meshes being provided in a region of the edge of the heat shield, or more particularly, extending along the edge.

The wire mesh may laterally extend on the housing beyond the edge of the heat shield, which simplifies the assembly of the heat shield.

For example, the second attachment point is provided in that region of the wire mesh which extends beyond the edge of the heat shield, i.e. which is not covered by the heat shield, whereby the thermal and acoustic insulation is further improved. Compared with the rest of the heat shield, the edge thereof may be angled toward the housing and, more particularly, may be in the form of a flange, allowing the heat shield to be mounted in a simple manner. In this context, the term "edge" is also understood as that portion of the heat shield which is adjacent to the edge of the heat shield, that is, the edge portion.

In one embodiment of the invention, an insulating cavity is formed between the heat shield and the housing and improves the thermal insulating effect of the heat shield.

In one variant configuration of the invention, the first attachment point and the second attachment point are arranged on a normal perpendicular to a surface of the housing, which ensures a simple mounting of both the wire mesh and the heat shield to the housing since the housing need not be moved between the process of attaching the wire mesh and the process of attaching the heat shield.

In another example configuration of the invention, the first attachment point and the second attachment point are arranged laterally offset in relation to each other as viewed in the direction of a normal to the surface of the housing, as a result of which the distance between the two attachment points is increased, and therefore the thermal and acoustic decoupling between the housing and the heat shield and also the mechanical decoupling are further improved.

In one example configuration of the invention, the wire mesh is attached to the housing by a substance-to-substance bond and/or with an interlocking fit, in particular by welding, such as spot welding, soldering, brazing, crimping, adhesive bonding, and/or stapling/tacking, and/or is attached to the heat shield by a substance-to-substance bond and/or with an interlocking fit, in particular by welding, such as spot welding, soldering, brazing, crimping, adhesive bonding, and/or stapling/tacking, using low-priced and well-proven connection methods.

An insulating material may be provided between the heat shield and the housing, more particularly in the insulating cavity, whereby the thermal insulation of the housing relative to the heat shield is further improved.

An insulating material may be accommodated in a clamped fashion in the insulating cavity.

The housing is, for example, a gas-carrying pipe, a housing of a catalytic converter, and/or of a particulate filter, allowing a more precise control of the temperatures in the interior of these parts of the exhaust system.

Also, the heat shield may be configured to be circumferentially closed around the housing, in particular as half shells, ensuring a best possible insulation.

It is, of course, also conceivable that the heat shield is perforated; usually, it is a formed metal sheet.

These and other features may be best understood from the following drawings and specification.

DETAILED DESCRIPTION

Figure 1:
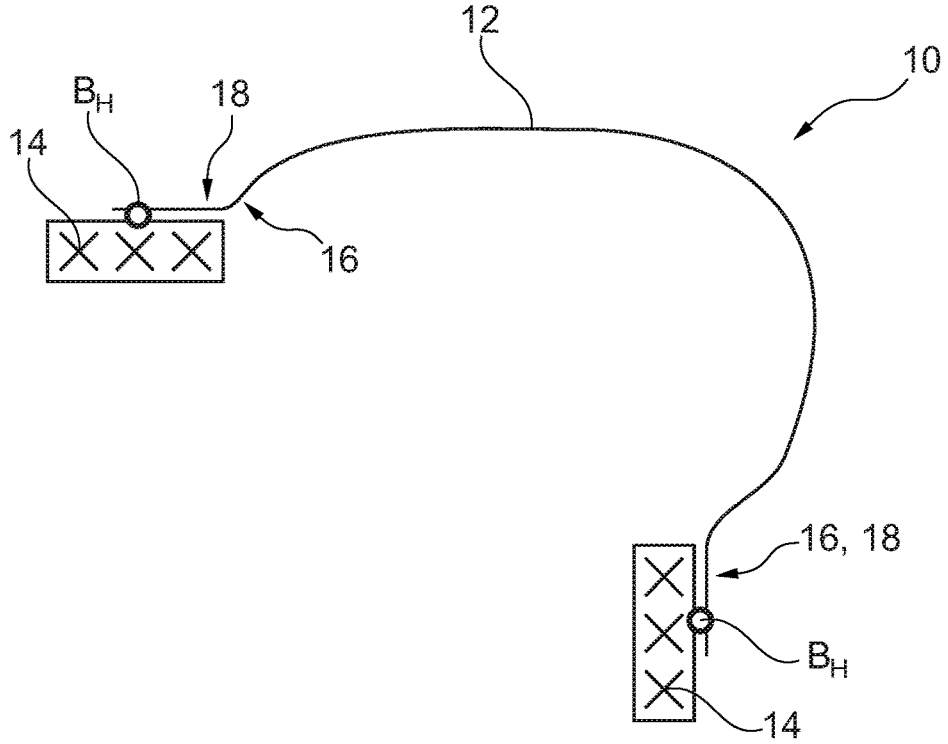
FIG. 1 schematically shows a section of a heat shield assembly according to the invention.

FIG. 1 shows a heat shield assembly 10 for a vehicle exhaust system. The heat shield assembly 10 includes a heat shield 12 having wire meshes 14 attached thereto.

The heat shield 12 constitutes a preassembled unit with the wire meshes 14.

For example, the heat shield 12 is made of a formed metal sheet having a thickness of from 0.14 mm to 0.5 mm and may be perforated. The shape of the heat shield 12 here essentially follows the shape of the component to which it is to be mounted.

In a first example embodiment, an edge 16 of the heat shield 12 is angled, so that the edge 16 is configured as a flange 18.

The wire meshes 14 are attached to the flange 18 at first attachment points BH.

The wire meshes 14 are evenly distributed along the entire edge 16, or the flange 18 of the heat shield 12, and thus constitute islands that are separate from each other. The edge 16 of the heat shield 12 may be lowered between the wire meshes 14 here, so that a crenellated structure may be obtained (see FIG. 3), which need not necessarily be the case.

The wire meshes 14 partly project over the edge 16 of the heat shield 12, so that the wire meshes 14 are partly exposed, that is, are not covered by the heat shield 12.

The wire mesh 14 can be attached to the heat shield 12 by a substance-to-substance bond and/or with an interlocking fit, in particular by welding, such as spot welding, soldering, brazing, crimping, adhesive bonding and/or stapling/tacking.

The heat shield 12 itself is closed between the wire mesh 14 and the heat shield 12 at the first attachment points BH, i.e. it has no bore holes, threads or similar fastening features.

Figure 2:
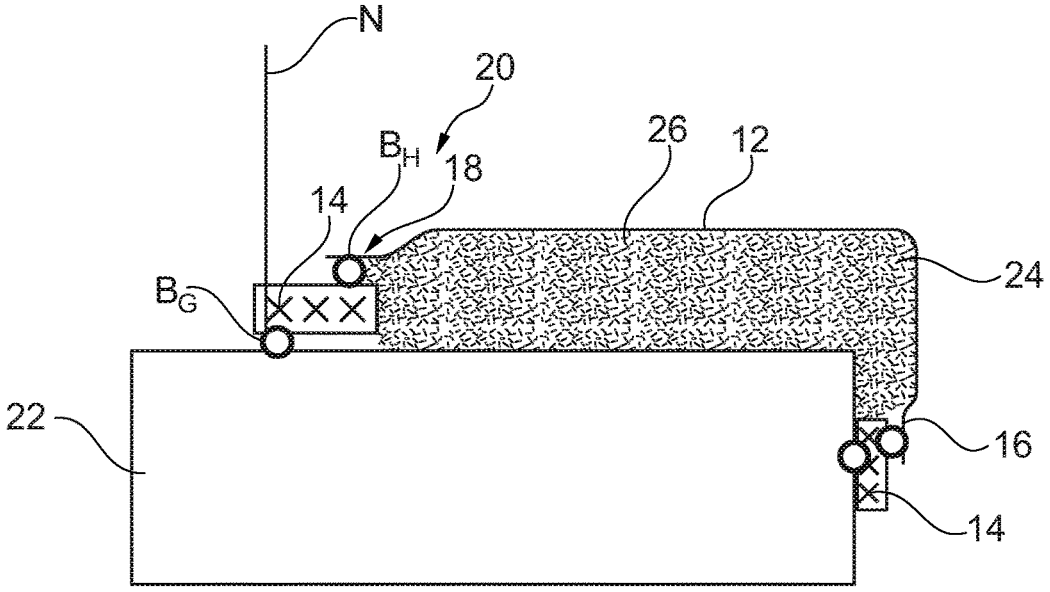
FIG. 2 schematically shows a section, along line II-II in FIG. 4, of an exhaust system component according to the invention.

FIG. 2 illustrates a first embodiment of an exhaust system component 20 in section.

In addition to the heat shield 12 and the wire meshes 14, that is, the heat shield assembly 10 according to FIG. 1, the exhaust system component 20 includes a gas-carrying housing 22.

Figure 4:
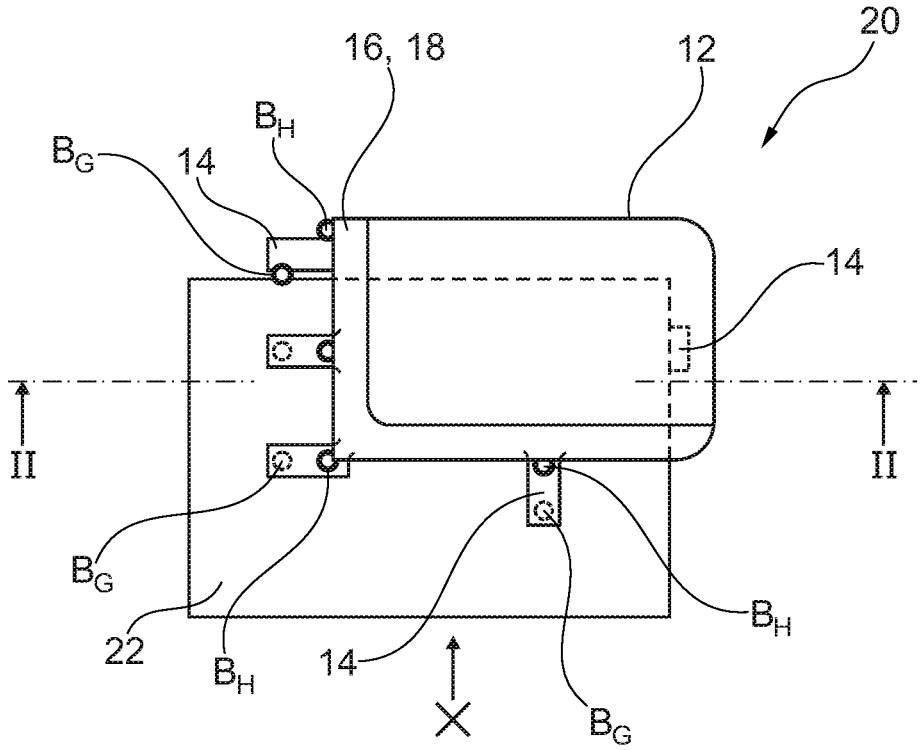
FIG. 4 schematically shows a top view of the exhaust system component according to FIG. 2.

The housing 22 is part of an exhaust system and, in operation of the vehicle, exhaust gases flow through the housing 22 in the direction of the arrow X in FIG. 4. The housing 22 is, for example, a housing of a catalytic converter (not shown) and/or of a particulate filter (not shown), in which the monolith is, e.g., clamped in the housing 22 via a bearing mat.

The heat shield 12 may also partly or completely shield the outside of an SCR system having an injection nozzle for, e.g., Diesel exhaust fluid (AdBlue), a static mixer and a mixing section as well as a catalytic converter connected downstream. At least some of the aforesaid parts of the SCR system may be received in the housing 22 here.

The heat shield 12 is externally attached to the housing 22 with the aid of the wire meshes 14 and has essentially the shape of the housing 22.

The heat shield 12 may be attached to the housing 22 exclusively via the wire meshes 14.

The wire meshes 14 are illustrated with an exaggerated thickness; in practice, the planar wire meshes rest by the flat side thereof against the housing 22.

The wire meshes 14 are attached to the housing 22 at second attachment points BG; such attachment may also be effected by a substance-to-substance bond and/or with an interlocking fit, in particular by welding, such as spot welding, soldering, brazing, crimping, adhesive bonding and/or stapling/tacking.

The wire mesh 14 holds the shield 12 to the housing 22 in all spatial directions, i.e. the mesh 14 transfers all forces between the first BH and the second BG attachment points. Thus, the first BH and second BG attachment points rigidly attach a specific portion of the mesh 14 to the shield 12 and the housing 22, respectively. As the attachment points are distanced from each other, the mesh 14 and not the attachment interface has to transfer all forces between the attachment points in all spatial directions.

An insulating cavity 24 is formed between the heat shield 12 and the housing 22 in that the edge 16 or the flange 18 of the heat shield 12 is angled toward the housing 22, as against the rest of the heat shield 12. Here, the insulating cavity 24 may be filled with an insulating material 26 which is clamped, e.g., between the housing 22 and the heat shield 12.

For attaching the heat shield 12, the wire meshes 14 are each attached to the heat shield 12 at the first attachment points BH and to the housing 22 at the second attachment points BG, respectively.

The first attachment points BH are each spatially separate from the second attachment points BG, that is to say, more particularly, there is no weld seam connecting the first attachment points BH and second attachment points BG.

The second attachment points BG are each arranged in that area of the wire meshes 14 which extends laterally over the edge 16 or the flange 18 of the heat shield 12 on the housing 22. This area of the wire meshes 14 is not covered by the heat shield 12.

Figure 3:
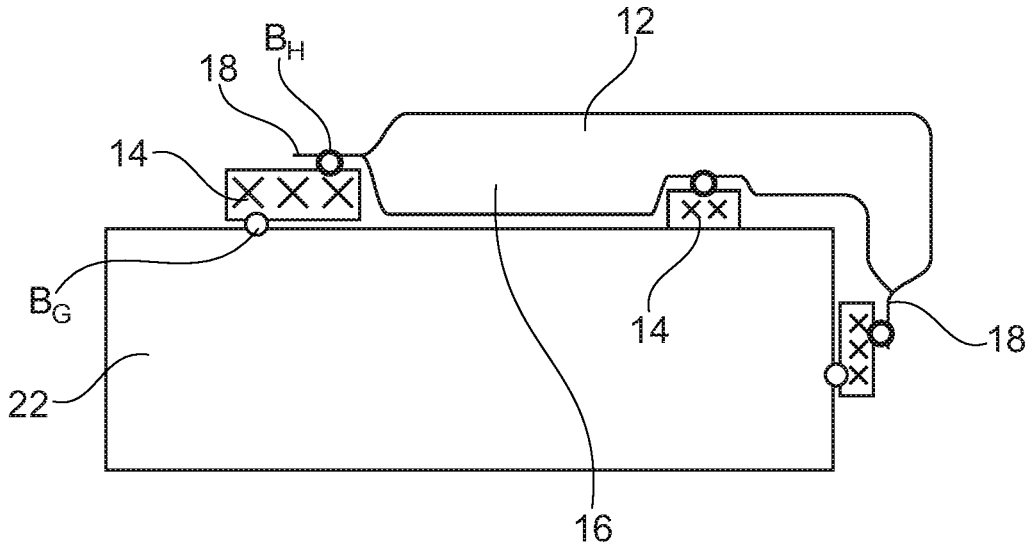
FIG. 3 shows the exhaust system component according to FIG. 2 in a schematic side view as seen in the direction of the arrow X in FIG. 4.

As can be seen well in FIG. 3, this arrangement results in that the first attachment point BH and the second attachment point BG are arranged so as to be laterally offset in relation to each other in the direction of a normal N to the surface of the housing 22 at which the second attachment points BG are located. This arrangement of the second attachment point BG allows the heat shield assembly 10 to be mounted to the housing 22 in a simple way if the heat shield assembly 10 is provided separately as a preassembled unit since the parts of the wire mesh 14 are not covered by the heat shield 12.

Furthermore, the different coefficients of expansion of the heat shield 12 and of the housing 22 can be compensated by the wire meshes 14 since different degrees of expansion are balanced by the wire meshes 14.

In addition, a heat transfer and a transmission of vibrations from the housing 22 to the heat shield 12 can occur only by way of the wire meshes 14, which, however, are both poor thermal conductors and also damp acoustic vibrations. In this way, the heat shield 12 is thermally and acoustically insulated from the housing.

An advantage in this embodiment is the comparatively large distance between the second attachment points BG and the first attachment points BH, which intensifies the insulating effect of the wire meshes 14 just described above. The larger distance is produced by the lateral offset of the attachment points BH, BG.

Figure 5:
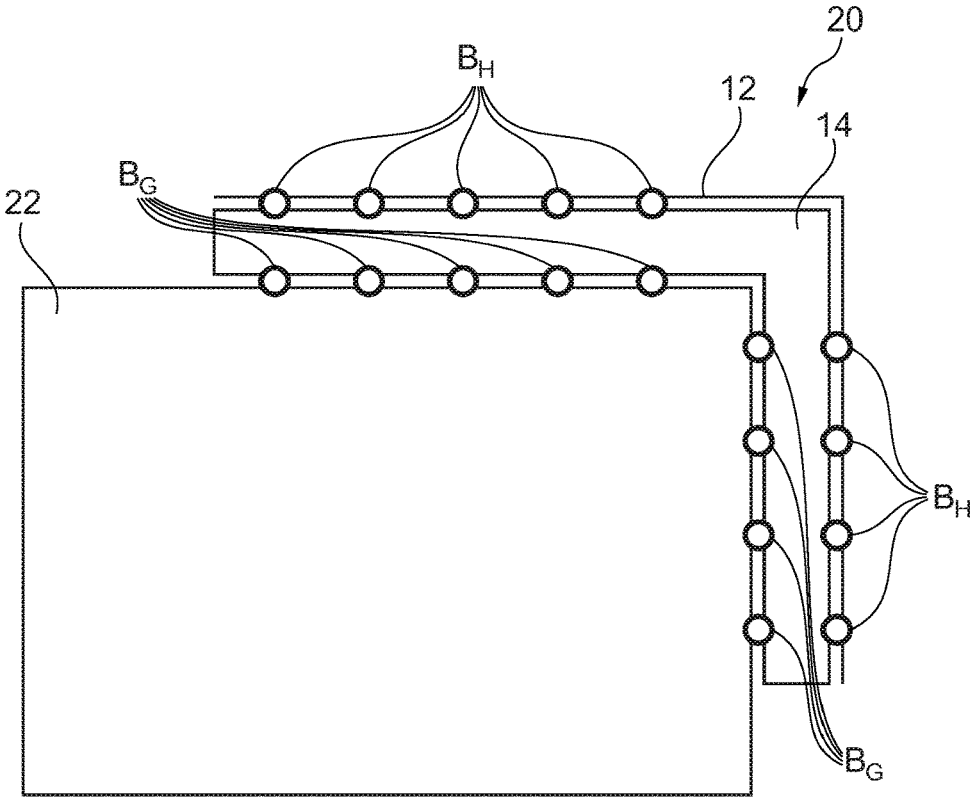
FIG. 5 shows a schematic side view of a second embodiment of an exhaust system component according to the invention.

FIG. 5 illustrates a second embodiment of the exhaust system component 20. The second embodiment substantially corresponds to the embodiment according to FIG. 2, and identical or functionally identical parts are provided with the same reference numbers. Only the differences will be discussed below.

Figure 6:
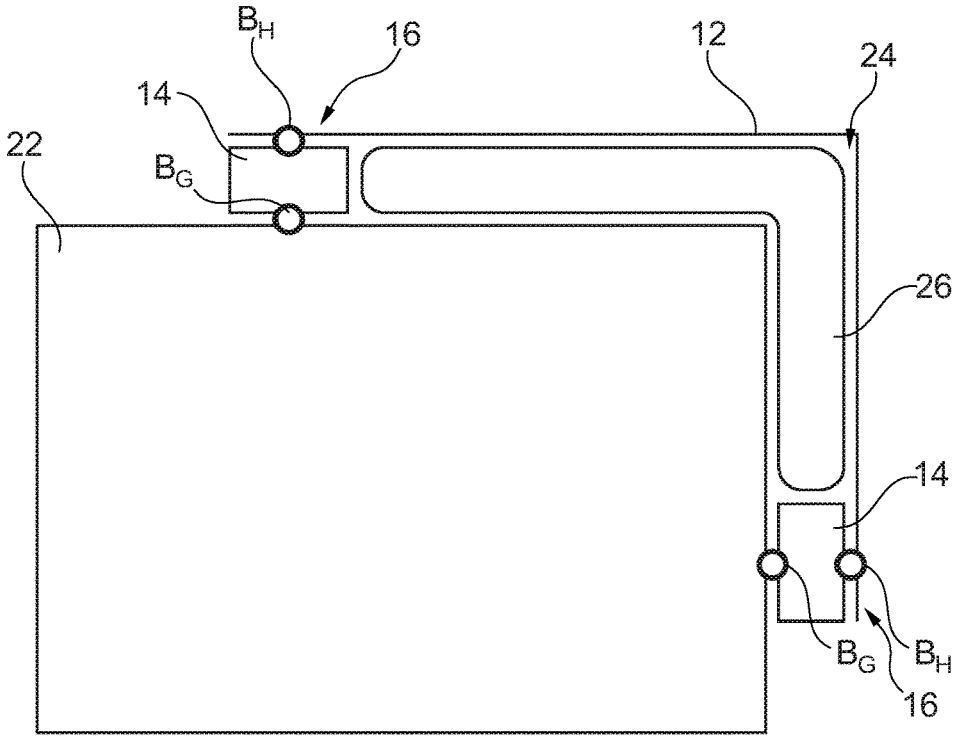
FIG. 6 shows a schematic sectional view of the exhaust system component according to FIG. 5.

In the second embodiment according to FIGS. 5 and 6, only one wire mesh 14 is provided which is formed like a strip or bead.

The wire mesh 14, which is illustrated with an excessive thickness here, too, extends along the edge 16 of the heat shield 12.

In this second embodiment, the edge 16 of the heat shield 12 is now no longer formed as a flange, but flatly with the rest of the heat shield 12; in this respect, the features of the embodiments may also be exchanged or altered.

Also, the wire mesh 14, for example, does not extend beyond the edge 16 of the heat shield 12, which should be understood as an optional feature. As can be seen in FIGS. 5 and 6, each first attachment point BH is associated with a second attachment point BG, which are arranged above one another and on a normal perpendicular to the surface of the housing 22.

To manufacture an exhaust system component 20 according to the second embodiment, first the wire mesh 14 is attached to the housing 22.

Only subsequently is the heat shield 12 attached to the wire mesh 14.

Also in the second embodiment, an insulating cavity 24 for provision of an insulating material 26 therein is produced between the housing 22 and the heat shield 12.

Due to the fact that the wire mesh 14 does not protrude beyond the edge 16 of the heat shield 12 and the heat shield 12 does not have a flange, the exhaust system component 20 of the second embodiment is more compact in comparison with that of the first embodiment, and therefore requires less installation space.

Figure 7:
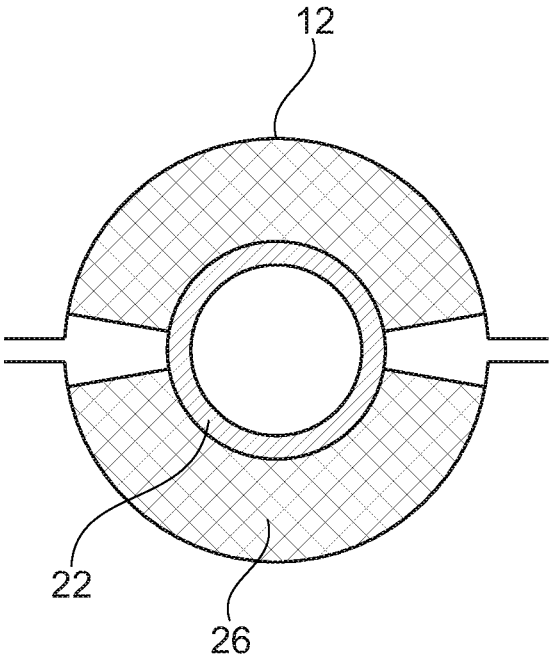
FIG. 7 shows a schematic cross-sectional view of a third embodiment of an exhaust system component according to the invention.
Figure 8:
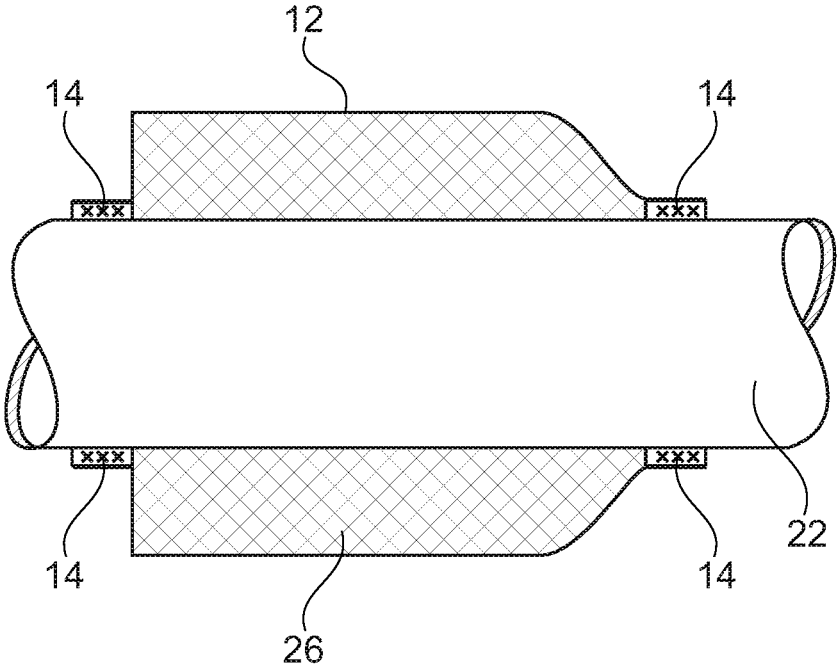
FIG. 8 shows a view of a longitudinal section through the third embodiment according to FIG. 7.

FIGS. 7 and 8 illustrate a third embodiment of the exhaust system component 20. The third embodiment essentially corresponds to the preceding embodiments, and identical or functionally identical parts are provided with the same reference numbers. Only the differences will be discussed below.

In the third embodiment, the housing 22 is configured as a gas-carrying pipe.

The heat shield 12 in this embodiment is in the form of two half-shells which circumferentially surround the housing 22.

Thus, the heat shield 12 is circumferentially completely or almost completely closed. Only for a clearer illustration of the flanges of the half shells are they shown spaced apart. The insulating cavity 24 is filled with insulating material 26 between the heat shield 12 and the housing 22.

The features of the various embodiments may, of course, be combined with one another as desired. The embodiments shown should be understood merely as examples as regards their combination of features.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A heat shield assembly for a vehicle exhaust system consisting of:

a single unitary solid piece heat shield;

at least one wire mesh configured to attach the heat shield to a housing of the vehicle exhaust system, the at least one wire mesh being attached to the heat shield at a first attachment point to form a preassembled unit and having a second attachment point configured for attachment to the housing, the first attachment point being separate from the second attachment point, and wherein the at least one wire mesh is attached to the heat shield at the first attachment point by a substance-to-substance bond that directly bonds the at least one wire mesh to the heat shield, and wherein the heat shield is closed at an inner surface facing the at least one wire mesh at the first attachment point such that there are no fastening openings in the heat shield at the first attachment point; and wherein the at least one wire mesh partly projects over an edge of the heat shield.

2. The heat shield assembly according to claim 1, wherein the at least one wire mesh is attached to the heat shield at the first attachment point with an interlocking fit in addition to the substance-to-substance bond.

3. An exhaust system component of a motor vehicle comprising:

a gas-carrying housing;

a heat shield seated on an outside of the gas-carrying housing; and at least one wire mesh which is provided at least partly between the heat shield and the gas-carrying housing to attach the heat shield to the gas-carrying housing and which has a first attachment point and a second attachment point, the heat shield being attached to the gas-carrying housing via the at least one wire mesh by the first attachment point and being attached to the gas-carrying housing by the second attachment point which contacts the gas-carrying housing directly, wherein the first attachment point is separate from the second attachment point;

wherein the first attachment point is a direct and fixed attachment between the heat shield and the at least one wire mesh, wherein the second attachment point is a direct and fixed attachment between the at least one wire mesh and the gas-carrying housing, and wherein the at least one wire mesh is attached to the heat shield at the first attachment point by a substance-to-substance bond that directly bonds the at least one wire mesh to the heat shield; and wherein the first attachment point and the second attachment point are arranged laterally offset in relation to each other as viewed in a direction of a normal to a surface of the gas-carrying housing that the second attachment point is directly attached to.

4. The exhaust system component according to claim 3 wherein the heat shield is closed at the first attachment point such that there are no fastening openings in the heat shield at the first attachment point.

5. The exhaust system component according to claim 3, wherein the heat shield is adapted to the shape of the housing.

6. The exhaust system component according to claim 3, wherein the at least one wire mesh is in the form of a strip.

7. The exhaust system component according to claim 3, wherein the at least one wire mesh comprises a plurality of separate wire meshes.

8. An exhaust system component of a motor vehicle, comprising:

a gas-carrying housing;

a heat shield seated on an outside of the gas-carrying housing; and at least one wire mesh which is provided at least partly between the heat shield and the gas-carrying housing to attach the heat shield to the gas-carrying housing and which has a first attachment point and a second attachment point, the heat shield being attached to the gas-carrying housing via the at least one wire mesh by the first attachment point and being attached to the gas-carrying housing by the second attachment point which contacts the gas-carrying housing directly, wherein the first attachment point is separate from the second attachment point;

wherein the first attachment point is a direct and fixed attachment between the heat shield and the at least one wire mesh, wherein the second attachment point is a direct and fixed attachment between the at least one wire mesh and the gas-carrying housing, and wherein the at least one wire mesh is attached to the heat shield at the first attachment point by a substance-to-substance bond that directly bonds the at least one wire mesh to the heat shield;

wherein the heat shield has an edge, and wherein the at least one wire mesh is provided in a region of the edge of the heat shield;

wherein the at least one wire mesh extends along the edge;

wherein the at least one wire mesh extends on the gas-carrying housing beyond the edge of the heat shield; and wherein the second attachment point is provided in a region of the at least one wire mesh which is not covered by the heat shield.

9. The exhaust system component according to claim 8, wherein compared with a remaining portion of the heat shield, the edge thereof is angled toward the gas-carrying housing.

10. The exhaust system component according to claim 3, wherein an insulating cavity is formed between the heat shield and the gas-carrying housing.

11. The exhaust system component according to claim 3, wherein the first attachment point and the second attachment point are arranged at least one of laterally offset from each other and on a normal perpendicular to a surface of the gas-carrying housing.

12. The exhaust system component according to claim 3, wherein the at least one wire mesh is attached to at least one of the gas-carrying housing and the heat shield by at least one of a substance-to-substance bond and with an interlocking fit.

13. The exhaust system component according to claim 12 wherein the at least one wire mesh is attached to at least one of the gas-carrying housing and the heat shield by at least one of welding, soldering, brazing, crimping, adhesive bonding, stapling, and tacking.

14. The exhaust system component according to claim 3, wherein an insulating material is provided between the heat shield and the gas-carrying housing.

15. The heat shield assembly according to claim 1, wherein the second attachment point provides a surface that is configured for direct and fixed attachment to the housing by a substance-to-substance bond.

16. The heat shield assembly according to claim 1, wherein the at least one wire mesh has a first side and a second side opposite the first side, and wherein the first attachment point is between the first side and an inner surface of the heat shield, and wherein the second attachment point is between the second side and an outer surface of the housing.

17. The exhaust system component according to claim 3, wherein the at least one wire mesh has a first side and a second side opposite the first side, and wherein the first attachment point is between the first side and an inner surface of the heat shield, and wherein the second attachment point is between the second side and an outer surface of the housing.

18. The exhaust system component according to claim 3, wherein the at least one wire mesh is attached to the housing at the second attachment point by a substance-to-substance bond.

19. The heat shield assembly according to claim 1, wherein the first attachment point and the second attachment point are arranged laterally offset in relation to each other as viewed in a direction of a normal to a surface of the gas-carrying housing that the second attachment point is directly attached to.

20. The heat shield assembly according to claim 1, wherein the at least one wire mesh thermally and mechanically decouples the heat shield from the housing.

21. The exhaust system component according to claim 3, wherein the at least one wire mesh thermally and mechanically decouples the heat shield from the gas-carrying housing.

* * * * *